US010299596B2

(12) United States Patent
White et al.

(10) Patent No.: US 10,299,596 B2
(45) Date of Patent: May 28, 2019

(54) MECHANICAL EXTENDING LINKAGE AND SEATING UNIT COMPRISING THE SAME

(71) Applicant: LEGGETT & PLATT (JIAXING) CO. LTD., Jiaxing (CN)

(72) Inventors: Nikki White, Pontotoc, MS (US); Yunhua Sun, Jiaxing (CN); Ziliu Pan, Jiaxing (CN); Liming Yang, Jiaxing (CN)

(73) Assignee: LEGGETT & PLATT (JIAXING) CO. LTD., Jiaxing (CN)

( * ) Notice: Subject to any disclaimer, the term of this patent is extended or adjusted under 35 U.S.C. 154(b) by 0 days.

(21) Appl. No.: 15/787,216

(22) Filed: Oct. 18, 2017

(65) Prior Publication Data

US 2018/0103761 A1 Apr. 19, 2018

(30) Foreign Application Priority Data

Oct. 19, 2016 (CN) ..... 2016 1 0910909

(51) Int. Cl.

| | |
|---|---|
| ***A47C 1/02*** | (2006.01) |
| ***A47C 1/034*** | (2006.01) |
| ***A47C 1/035*** | (2006.01) |
| ***A47C 1/036*** | (2006.01) |
| ***A47C 1/037*** | (2006.01) |
| ***A47C 1/0355*** | (2013.01) |
| ***A47C 7/50*** | (2006.01) |

(52) U.S. Cl.

CPC ..... *A47C 1/0355* (2013.01); *A47C 1/0352* (2013.01); *A47C 7/506* (2013.01)

(58) Field of Classification Search

CPC ..... A47C 1/0352; A47C 1/0355; A47C 7/506
USPC ..... 297/68, 69, 83, 84
See application file for complete search history.

(56) References Cited

U.S. PATENT DOCUMENTS

| | | | | | |
|---|---|---|---|---|---|
| 4,674,794 | A * | 6/1987 | Pine | A47C 1/0345 | 297/68 X |
| 5,054,850 | A * | 10/1991 | Pine | A47C 1/0345 | 297/68 |
| 5,087,094 | A * | 2/1992 | Rogers, Jr. | A47C 1/0355 | 297/68 |
| 5,090,768 | A * | 2/1992 | Re | A47C 7/506 | 297/68 |
| 5,110,179 | A * | 5/1992 | Rogers | A47C 1/0355 | 297/68 |

(Continued)

*Primary Examiner* — Rodney B White
(74) *Attorney, Agent, or Firm* — Shook, Hardy & Bacon L.L.P.

(57) ABSTRACT

A mechanical extending linkage is configured to be mounted in a seating unit capable of being moved between a retracted position and an extended position and comprising a seat, a backrest and extendable primary and secondary footrests. The mechanical extending linkage comprises a footrest assembly for extending and retracting the primary footrest and the secondary footrest, the footrest assembly comprising a primary footrest link, a secondary footrest link, and an intermediate link set having a first intermediate link, a second intermediate link, a third intermediate link and a fourth intermediate link. The footrest assembly is configured in such a manner that the secondary footrest link, the first intermediate link and the second intermediate link are arranged substantially parallel with the seat when the seating unit is in the retracted position.

17 Claims, 4 Drawing Sheets

(56) References Cited

U.S. PATENT DOCUMENTS 5,129,701 A * 7/1992 Pine ..... A47C 1/0355 297/68
5,800,010 A * 9/1998 May ..... A47C 1/0355 297/84
5,823,614 A * 10/1998 Johnson ..... A47C 1/0352 297/68 X
6,729,686 B2 * 5/2004 May ..... A47C 1/0355 297/84
7,396,074 B2 * 7/2008 Wiecek ..... A47C 1/0355 297/68
7,445,279 B2 * 11/2008 Crum ..... A47C 1/0355 297/68
7,669,921 B2 * 3/2010 Hoffman ..... A47C 1/037 297/84 X
7,673,933 B2 * 3/2010 Lawson ..... A47C 1/0345 297/69
7,762,625 B2 * 7/2010 Hoffman ..... A47C 1/0355 297/84 X
8,308,228 B2 * 11/2012 Lawson ..... A47C 1/035 297/85 R X
8,398,165 B2 * 3/2013 Lawson ..... A47C 3/027 297/85 M X
8,398,168 B2 * 3/2013 Lawson ..... A47C 1/0355 297/68 X
8,449,027 B2 * 5/2013 Wiecek ..... A47C 1/0342 297/84 X
8,573,687 B2 * 11/2013 Lawson ..... A47C 1/0355 297/84
8,590,964 B2 * 11/2013 Murphy ..... A47C 1/037 297/84
8,616,627 B2 * 12/2013 Murphy ..... A47C 1/0355 297/84 X
8,622,467 B2 * 1/2014 Murphy ..... A47C 1/037 297/84 X
8,752,890 B2 * 6/2014 Murphy ..... A47C 1/037 297/423.35
8,911,009 B2 * 12/2014 Hoffman ..... A47C 1/03266 297/84 X
8,967,718 B2 * 3/2015 Hoffman ..... A47C 1/03272 297/259.2
9,039,078 B2 * 5/2015 Lawson ..... A47C 1/035 297/85 R X
2003/0057743 A1 * 3/2003 May ..... A47C 1/0355 297/84
2006/0249993 A1 * 11/2006 Rogers ..... A47C 1/0355 297/68
2008/0150329 A1 * 6/2008 Lawson ..... A47C 1/0355 297/84
2010/0283297 A1 * 11/2010 Crum ..... A47C 1/035 297/84
2011/0304193 A1 * 12/2011 Murphy ..... A47C 1/034 297/84 X
2012/0119547 A1 * 5/2012 Hoffman ..... A47C 1/0355 297/84
2012/0235449 A1 * 9/2012 Wiecek ..... A47C 1/0342 297/84
2012/0299363 A1 * 11/2012 Crum ..... A47C 1/0355 297/84 X
2013/0038095 A1 * 2/2013 Lawson ..... A47C 1/035 297/83
2014/0132038 A1 * 5/2014 Lu ..... A47C 1/035 297/68
2014/0132039 A1 * 5/2014 Lu ..... A61G 15/02 297/68
2015/0054315 A1 * 2/2015 Donovan ..... A47C 1/0242 297/68
2016/0029800 A1 * 2/2016 Bryant ..... A47C 1/034 297/284.3

* cited by examiner

MECHANICAL EXTENDING LINKAGE AND SEATING UNIT COMPRISING THE SAME

CROSS-REFERENCE TO RELATED APPLICATIONS

This Nonprovisional patent application claims priority to co-pending Chinese Patent Application No. 201610910909.X, which was foreign filed Oct. 19, 2016, and which is titled "Mechanical Stretch Device and Seat Unit Comprising Same," the contents of which is incorporated herein by reference in its entirety.

TECHNICAL FIELD

The present invention relates to a mechanical extending linkage, and in particular to a mechanical extending linkage used in a seating unit, e.g., a recliner mechanism used in a sofa. The present invention further relates to a seating unit including the mechanical extending linkage.

BACKGROUND ART

Now multi-functional sofas have seen wide application. Generally, these available sofas provide three basic positions, a standard non-reclining retracted position, an extended position and a reclining position. In the retracted position, a seat is substantially horizontally oriented while a backrest is substantially vertically arranged. In addition, if the sofa comprises a footrest linkage, the linkage is folded to prevent the footrest from extending. In an extended position, usually a position suitable for watching TV, the footrest is extended forward of the seat while the backrest is maintained vertical enough to permit an occupant of the seating unit to watch TV comfortably. In the reclining position, the backrest is orientated backward (reclined) from the extended position to form an obtuse angle relative to the seat for rest or sleeping.

However, in the retracted position, the mechanical extending linkage of these known sofas takes up a larger space even if being folded, which consequently results in a thick position for placing legs as well as an ugly appearance and unpopular form. Therefore, it is necessary to have a space-saving and simple design.

Besides, in the extended position and the reclining position, the total extended length of currently available footrest linkage for sofas is still not long enough to meet the requirement in comfort. Therefore, there is a need to provide a design with increased extended length.

SUMMARY

One objective of the present invention is to provide mechanical extending linkage to overcome one of the above defects in prior art. Preferably, the above defects in prior art can be solved simultaneously by the simple and clever design of the present invention effectively and cooperatively.

According to a first aspect of the present invention, a mechanical extending linkage is provided, configured to be mounted in a seating unit capable of being movable between a retracted position and an extended position and comprising a seat, a backrest and extendable primary and secondary footrests. The mechanical extending linkage comprises a footrest assembly for extending and retracting the primary footrest and the secondary footrest, the footrest assembly comprising a primary footrest link, a secondary footrest link, and an intermediate link set having a first intermediate link, a second intermediate link, a third intermediate link and a fourth intermediate link, wherein the seat is supported by a seat mounting plate to which the secondary footrest link is coupled via sequentially the first intermediate link and the third intermediate link, and to which the primary footrest link is coupled via sequentially the second intermediate link and the fourth intermediate link, and wherein the footrest assembly is configured in such a manner that the secondary footrest link, the first intermediate link and the second intermediate link are arranged substantially parallel with the seat when the seating unit is in the retracted position.

Because the plurality of links directly connected to the primary footrest are substantially parallel with the seat when the seating unit is in the retracted position, the thickness of a front part (i.e., the part of the seat for placing legs when in the retracted position) of the seat is reduced, which thickness is measured generally along a vertical direction. By virtue of this, the appearance of the seating unit becomes simple and light, and the seat provides more space below, thus improving comfort. Meanwhile, when the seating unit is in the extended position, the secondary footrest link is extended forward to extend an extension length of the footrest assembly and to further increase a total extension length of the mechanical extending linkage. The defects in the prior art therefore are solved cleverly and cooperatively.

According to a preferred embodiment, the footrest assembly further comprises a secondary footrest drive link connected between the primary footrest link and the secondary footrest link. Preferably, when the seating unit is in the retracted position, the primary footrest link is substantially vertically arranged, and the secondary footrest link and the secondary footrest drive link are arranged in such a manner that distances between the seat and a distal end of the secondary footrest link and a distal end of the secondary footrest drive link are smaller than or equal to a distance between the seat and a distal end of the primary footrest link. Hence, in a retracted state, all the links directly connected to the primary footrest are substantially arranged parallel with the seat or entirely within a certain range that is only dependent on a vertical length of the primary footrest link without being affected by other links to effectively reduce the thickness of the front part of the seat. More preferably, when the seating unit is in the retracted position, the secondary footrest link, the first intermediate link and the second intermediate link are arranged to at least partially overlap one another, and the first to fourth intermediate links at least partially overlap one another to further realize a relatively small structural thickness of the lower part of the seat.

Preferably, the primary footrest link, the secondary footrest drive link and the first, second, third and fourth intermediate links each have a first end and a second end. The secondary footrest drive link, at the first end thereof, is pivotally connected to the secondary footrest link by means of a secondary footrest pivot, and at the second end thereof, is pivotally connected to the first end of the primary footrest link. The first intermediate link, at the first end thereof, is pivotally connected to an end of the secondary footrest link, and at the second end thereof, is pivotally connected to the first end of the third intermediate link, and is pivotally connected to the primary footrest link via the primary footrest pivot. The second intermediate link, at the first end thereof, is pivotally connected to the second end of the primary footrest link, and at the second end thereof, is pivotally connected to the first end of the fourth intermediate link, and both the second end of the third intermediate link and the second end of the fourth intermediate link are pivotally connected to the seat mounting plate. In this way, an increased extension length of the footrest assembly can be realized by this simple structure.

According to another preferred embodiment, the footrest assembly further comprises an intermediate footrest which is positioned between the seat and the primary footrest when the primary footrest is extended to provide further support for legs.

Preferably, the intermediate footrest comprises an intermediate footrest bracket, and an intermediate footrest link having a first end and a second end, wherein an end of the intermediate footrest bracket is pivotally connected to the second intermediate link; the intermediate footrest link, at the first end thereof, is pivotally connected to the intermediate footrest bracket via an intermediate footrest pivot, and at the second end thereof, is pivotally connected to the first intermediate link, such that the intermediate footrest is configured in a simple and compact structure. Preferably, when the seating unit is in the retracted position, the intermediate footrest link and the intermediate footrest bracket are arranged substantially parallel with the seat, and a distance between the seat and a distal end of the intermediate footrest link and a distal end of the intermediate footrest bracket are smaller than a distance from the seat and a distal end of the primary footrest link to ensure relatively small thickness of the front part of the seat.

According to another preferred embodiment, the second intermediate link and the fourth intermediate link are provided with a stop member respectively to stop the footrest assembly when it is extended and retracted.

According to another preferred embodiment, the mechanical extending linkage further comprises a seat assembly and a backrest assembly, wherein the seat assembly extends and retracts the seat of the seating unit in a translating manner, and the backrest assembly allows the backrest of the seating unit to be adjustable between a substantially vertical position and a reclined position.

Preferably, the seat assembly comprises the seat mounting plate, a roller mounting plate, a rail mounting plate, at least one rotary link and at least one roller, wherein the at least one roller is mounted on the roller mounting plate; the rail mounting plate is provided with a rail groove for the roller; one end of each of the at least one rotary link is pivotally connected to the roller mounting plate, and the other end thereof is pivotally connected to the rail mounting plate such that the rail mounting plate is coupled to the roller mounting plate to the rail mounting plate, and the rail mounting plate is adapted to fix to a seating unit member independent of the mechanical extending linkage to achieve forward translation of the seat by a simple structure and allow further increase of the total extension length of the mechanical extending linkage. More preferably, the at least one roller comprises two rollers, and the at least one rotary link comprises a front rotary link and a rear rotary link.

Preferably, the backrest assembly comprises a backrest bracket, a backrest support bracket and at least one backrest link, wherein the backrest bracket and the backrest support bracket are connected to the seat mounting plate and the rail mounting plate via the at least one backrest link. More preferably, the at least one backrest link comprises a backrest auxiliary link, a backrest rotary link and a backrest lower link each having a first end and a second end, wherein the backrest auxiliary link has a generally U-shape, and is fixedly connected to the seat mounting plate at the bottom of the U-shape, pivotally connected to the backrest bracket at an end of one leg of the U-shape via a backrest bracket pivot, and pivotally connected to a backrest rotary link via the backrest rotary link pivot at an end of the other leg. One end of the backrest support bracket is pivotally connected to the backrest bracket, and the other end thereof is pivotally connected the first end of the backrest rotary link. The second end of the backrest rotary link is pivotally connected to the first end of the backrest lower link. The second end of the backrest lower link is pivotally connected to the rail mounting plate. Therefore, the roller moves forward to drive the backrest rotary link to rotate while driving the seat to move forward, and then drive the backrest bracket to tilt backward such that the seating unit reaches the reclining position. Hence, this simple structure increases the total extension length of the mechanical extending linkage.

According to a second aspect of the invention, a seating unit is provided, which is movable between the retracted position and the extended position and comprises a seat, a backrest and extendable primary and secondary footrests, wherein the seating unit comprises a pair of mechanical extending linkages in mirror symmetry, the mechanical extending linkages being configured according to the preceding embodiments. The seating unit may be a sofa.

According to a preferred embodiment, the seating unit further comprises a reclined position. When the seating unit is moved from the extended position to the reclined position, the seat is moved forward, and the backrest is moved from a substantially vertical position to tilt backward to form an obtuse angle relative to the seat, and at the same time the primary footrest and the secondary footrest remain in an extended state for the occupant to rest or sleep.

The summary of the invention is intended to introduce the options of the inventive concept of the invention in a simple way, and further illustration will be made in the following embodiments. The present summary is not intended to determine the key features or essential features of the claimed subject matter, nor is it intended to restrict the scope of the claimed subject matter.

BRIEF DESCRIPTION OF THE DRAWINGS

The following is a detailed illustration of the preferred embodiments of the present invention, in which.

DETAILED DESCRIPTION OF THE EMBODIMENTS

The embodiments are depicted particularly herein to meet legal requirements. However, the depiction is not intended to restrict the scope of the patent, but instead the claimed subject matter, as anticipated by the inventor, may be carried out by other means.

FIGS. 1-4 show a preferred embodiment of the present invention. The preferred mechanical extending linkage 100 is adapted to be mounted in a seating unit, e.g., a sofa. The seating unit is movable between a retracted position shown in FIG. 1 and an extended position shown in FIGS. 2 and 3 and comprises a seat, a backrest, a primary footrest and a secondary footrest, wherein the primary footrest and the secondary footrest are extended when the seating unit is in the extended position.

The mechanical extending linkage 100 may comprise a footrest assembly for extending and retracting the primary footrest and the secondary footrest, a seat assembly for extending and retracting the seat of the seating unit in a translating manner, and a backrest assembly for adjusting the backrest of the seating unit between a substantially vertical position and a reclined position.

Figure 1:
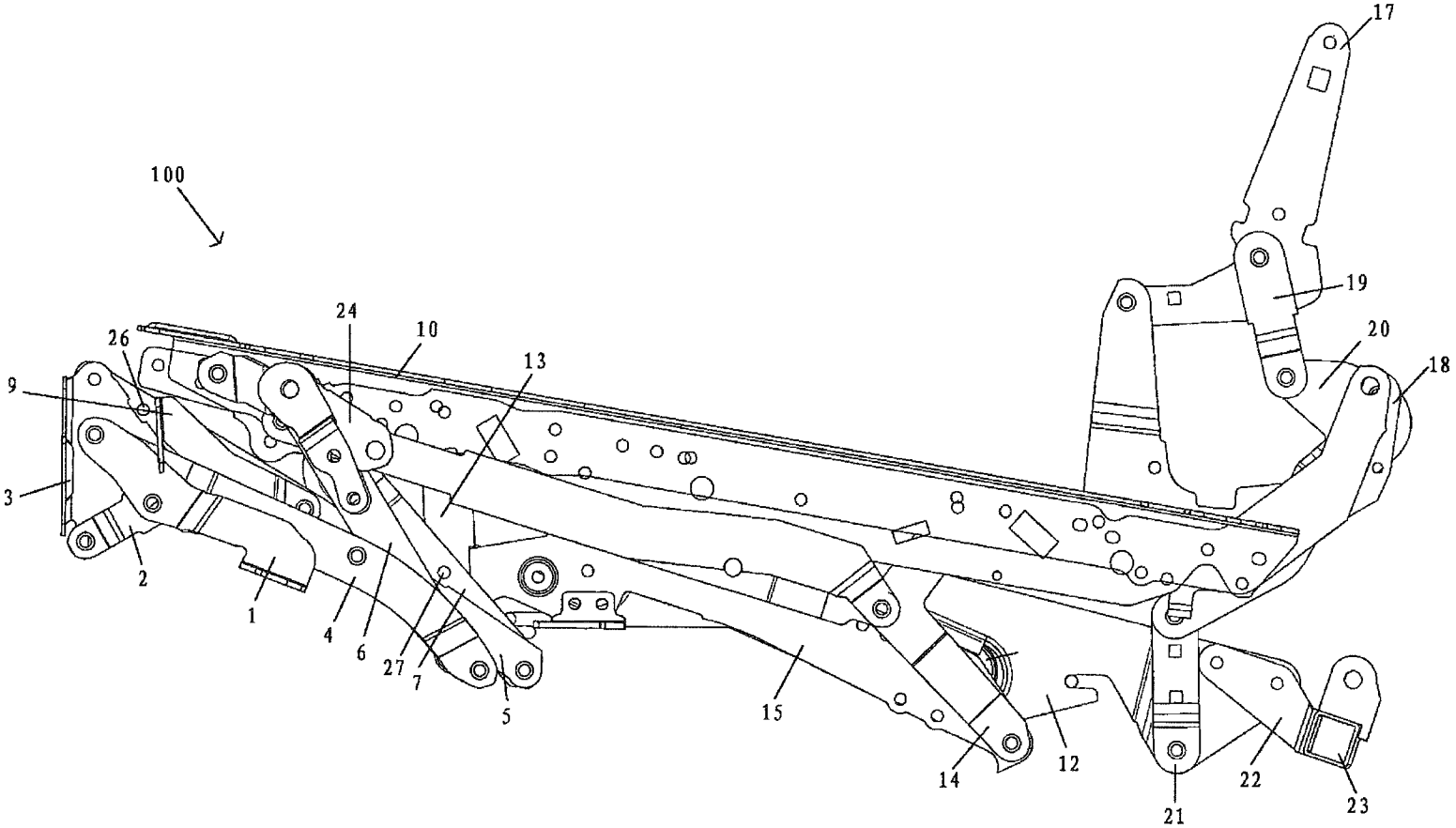
FIG. 1 is a diagrammatic side view of the mechanical extending linkage in a retracted position of the present invention.
Figure 2:
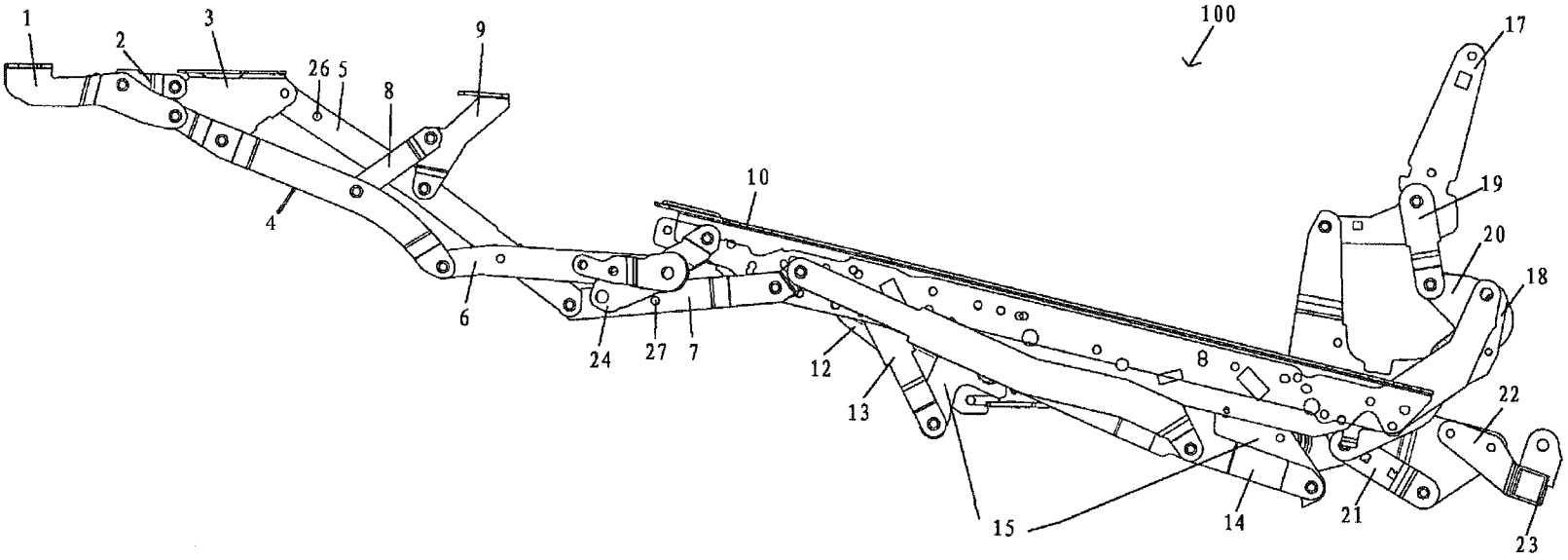
FIG. 2 is a diagrammatic side view of the mechanical extending linkage illustrated in FIG. 1 in an extended position.
Figure 3:
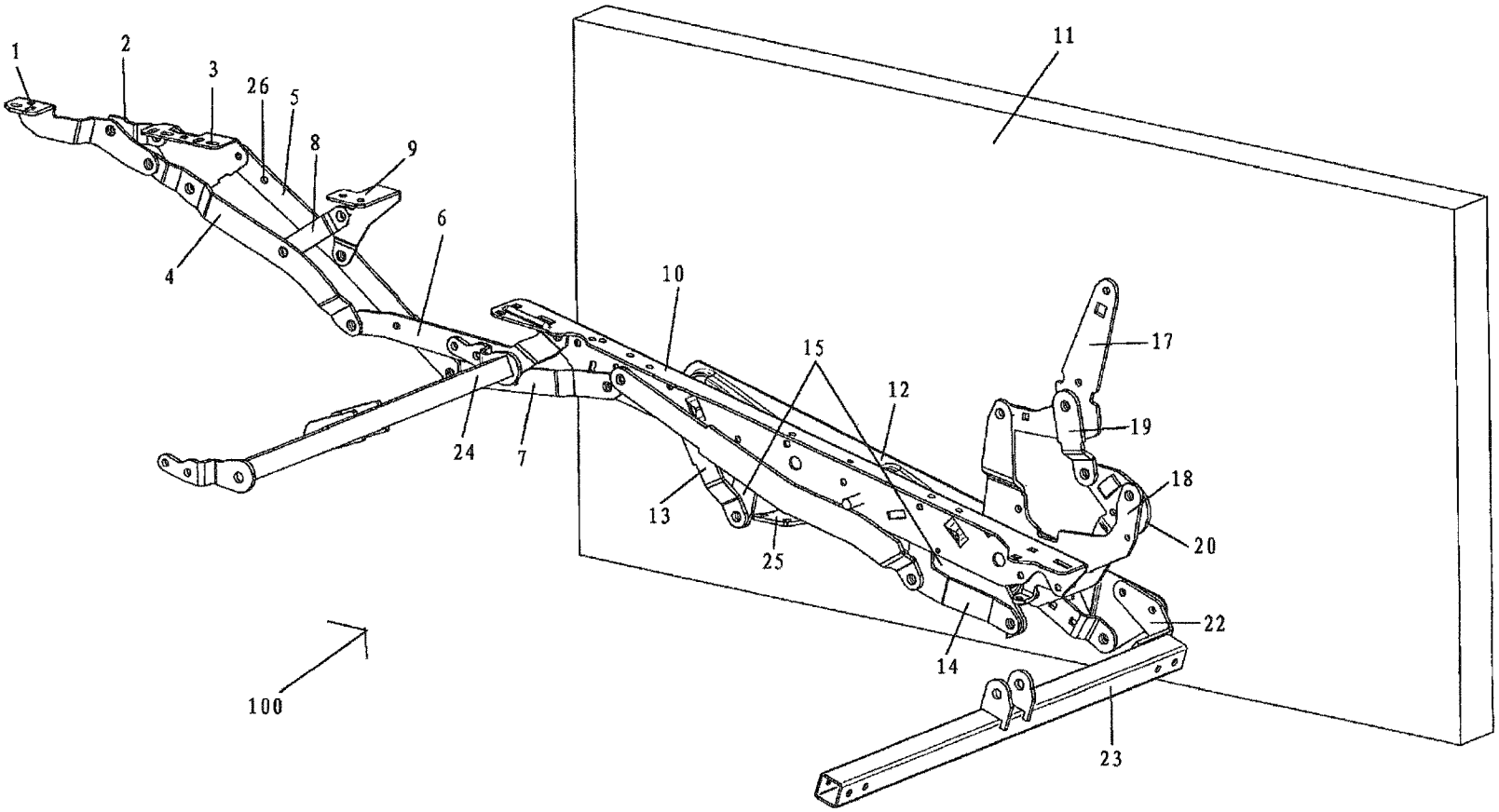
FIG. 3 is a diagrammatic perspective view of the mechanical extending linkage illustrated in FIG. 2.

FIGS. 2 and 3 show the mechanical extending linkage 100 in the extended position. The footrest assembly, as more clearly shown in FIG. 2, may comprise a primary footrest link 3, a secondary footrest link 1 and an intermediate link set formed by a first, second, third and fourth intermediate links 4, 5, 6, 7. The seat of the seating unit is supported by a seat mounting plate 10 to which the secondary footrest link 1 is coupled via sequentially the first intermediate link 4 and the third intermediate link 6, and to which the primary footrest link 3 is coupled via sequentially the second intermediate link 5 and the fourth intermediate link 7. As illustrated in FIG. 1, when the seating unit is in the retracted position, the secondary footrest link 1, the first intermediate link 4 and the second intermediate link 5 are arranged substantially parallel with the seat.

Moreover, the footrest assembly may further comprise a secondary footrest drive link 2 connected between the primary footrest link 3 and the secondary footrest link 1. It can be seen from FIG. 1 that when the seating unit is in the retracted position, the primary footrest link 3 is substantially vertically arranged, and a distance from the seat to a distal end of the secondary footrest link 1 and a distance from the seat to a distal end of the secondary footrest drive link 2 are smaller than or equal to a distance from the seat to a distal end of the primary footrest link 3. Besides, the secondary footrest link 1, the first intermediate link 4 and the second intermediate link 5 are arranged to at least overlap one another and the first, second, third fourth intermediate links 4, 5, 6, 7 at least overlap one another.

As shown in FIGS. 2 and 3, the primary footrest link 3, the secondary footrest drive link 2 and the first, second, third and fourth intermediate links 4, 5, 6, 7 each have a first end and a second end. The secondary footrest drive link 2, at the first end thereof, is pivotally connected to the secondary footrest link 1 by means of a secondary footrest pivot, and at the second end thereof, is pivotally connected to the first end of the primary footrest link 3. The first intermediate link 4, at the first end thereof, is pivotally connected to an end of the secondary footrest link 1, and at the second thereof, is pivotally connected to the first end of the third intermediate link 6, and is pivotally connected to the primary footrest link 3 by means of the primary footrest pivot to drive the primary footrest link 3 to rotate and extend during movement from the retracted position to the extended position. The second intermediate link 5, at the first end thereof, is pivotally connected to the second end of the primary footrest link 3, and at the second end thereof, is pivotally connected to the first end of the fourth intermediate link 7. Both the second end of the third intermediate link 6 and the second end of the fourth intermediate link 7 are pivotally connected to the seat mounting plate 10.

In addition, the footrest assembly further comprises an intermediate footrest which comprises an intermediate footrest bracket 9, and an intermediate footrest link 8 having a first end and a second end. As shown in FIGS. 2 and 3, when the primary footrest is extended, the intermediate footrest is positioned between the seat and the primary footrest to provide further support for legs. An end of the intermediate footrest bracket 9 is pivotally connected to the second intermediate link 5. The intermediate footrest link 8, at the first end thereof, is pivotally connected to the intermediate footrest bracket 9 via an intermediate footrest pivot, and at a second end thereof, is pivotally connected to the first intermediate link 4 to drive the intermediate footrest bracket 9 to rotate and extend during the movement from the retracted position to the extended position.

Again referring to FIG. 1, when the seating unit is in the retracted position, the intermediate footrest link 8 and the intermediate footrest bracket 9 are arranged substantially parallel with the seat, and distances between the seat and a distal end of the intermediate footrest link 8 and a distal end of the intermediate footrest bracket 9 are smaller than a distance between the seat and a distal end of the primary footrest link 3.

Preferably, the second intermediate link 5 and the fourth intermediate link 7 are provided with stop members 26, 27 respectively, which, as shown in FIG. 1, may be stop rivets, to stop the footrest assembly when the footrest assembly is extended and retracted.

Further referring to FIGS. 2 and 3, the seat assembly may comprise the seat mounting plate 10, a roller mounting plate 15, a rail mounting plate 12, at least one rotary link 13, 14 and at least one roller 16, wherein the roller 16 may be mounted on the roller mounting plate 15. The rail mounting plate 12 may be provided with a rail groove for the roller 16. The rotary link 13, 14 of the seat assembly each may be pivotally connected to the roller mounting plate 15 at one end, and pivotally connected to the rail mounting plate 15 at the other end such that the roller mounting plate 15 is coupled to the rail mounting plate 12. Preferably, two rollers 16 and two rotary links are provided, i.e., a front rotary link 13 and a rear rotary link 14. The rail mounting plate 12 is adapted to fix to a seating unit member 11, e.g., a wood frame of the seating unit, independent of the mechanical extending linkage 100. Consequently, the rail mounting plate acts as a fixing part for fixing the mechanical extending linkage entirely onto the seating unit. Those skilled in the art may envisage that the seating unit further comprises a known front motor drive tube 24 (mounted on a front motor mounting bracket) and a rear motor drive tube 23 (mounted on a rear motor mounting bracket 22) which are driven by an external force such that the footrest assembly is changed from a folded state into an extended state. Also, the roller mounting plate 15 may be provided with a known stabilizer tube mounting bracket 25 for mounting a stabilizer tube (not shown) to ensure stable operation of the mechanical extending linkage.

The backrest assembly may comprise a backrest bracket 17, a backrest support bracket 19 and at least one backrest link 18, 20, 21. The backrest bracket 17 and the backrest support bracket 19 are connected to the seat mounting plate 10 and the rail mounting plate 12 via the backrest link 18, 20, 21.

Specifically, the backrest link may comprise a backrest auxiliary link 18, a backrest rotary link 20 and a backrest lower link 21 each having a first end and a second end. The backrest auxiliary link 18 has generally a U-shape (see FIGS. 2 and 3), which link is fixedly connected to the seat mounting plate 10 at the bottom of the U-shape bottom thereof, pivotally connected to the backrest bracket 17 at an end of one leg of the U-shape via a backrest bracket pivot, and pivotally connected to a backrest rotary link 20 via the backrest rotary link pivot at an end of the other leg. One end of the backrest support bracket 19 is pivotally connected to the backrest bracket 17, and the other end thereof is pivotally connected to the first end of the backrest rotary link 20. The second end of the backrest rotary link 20 is pivotally connected to the first end of a backrest lower link 21. The second end of the backrest lower link 21 is pivotally connected to the rail mounting plate 12. In this way, when the roller moves forward the backrest auxiliary link 18 cooperates with the backrest lower link 21 to drive the backrest rotary link 20 to rotate and then to drive the backrest bracket 17 to tilt backward (i.e., recline) via the backrest support bracket 19, as shown in FIG. 4.

Figure 4:
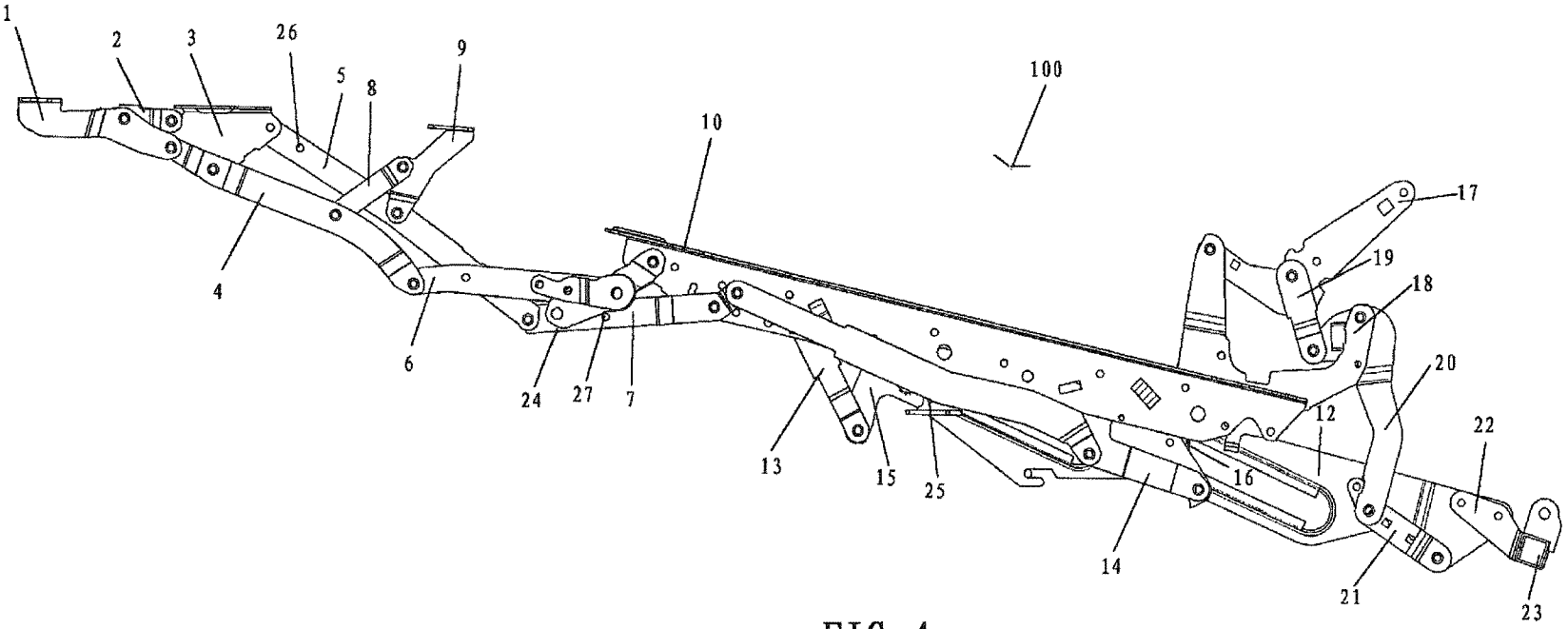
FIG. 4 is a diagrammatic side view of the mechanical extending linkage illustrated in FIG. 1 in a reclined position.

It can be seen from FIG. 4 that when the seating unit is moved from the extended position to the reclined position, the roller is moved forward in the rail groove by an external force in an extended state of the primary footrest and the secondary footrest, the seat is moved forward in a translating manner and the backrest is moved from the substantially vertical position to tilt backward to form an obtuse angle relative to the seat. The entire mechanism is therefore extended forward for reclining and rest by a user.

The mechanical extending linkage as well as the seating unit comprising the same is illustrated in the above embodiments herein. It should be noted that the above illustration is exemplary only, and those skilled in the art can make various modifications and variants to the above embodiments, which are encompassed within the protection scope of the present invention.

What is claimed is:

1. A mechanical extending linkage configured to be mounted in a seating unit which is movable between a retracted position and an extended position and comprises a seat, a backrest, and extendable primary and secondary footrests;

wherein, the mechanical extending linkage comprises a footrest assembly for extending and retracting the primary and secondary footrests, the footrest assembly comprising a primary footrest link, a secondary footrest link and an intermediate link set;

the intermediate link set comprises a first intermediate link, a second intermediate link, a third intermediate link and a fourth intermediate link;

the seat is supported by a seat mounting plate to which the secondary footrest link is coupled via sequentially the first intermediate link and the third intermediate link, and to which the primary footrest link is coupled via sequentially the second intermediate link and the fourth intermediate link, and the footrest assembly is configured in such a manner that when the seating unit is in the retracted position, the secondary footrest link, the first intermediate link and the second intermediate link are arranged substantially parallel with the seat, wherein one end of the secondary footrest link is pivotally connected to one end of the first intermediate link, so that when the seating unit is in the retracted position, the secondary footrest link is arranged to substantially overlap with the first intermediate link.

2. The mechanical extending linkage according to claim 1, wherein the footrest assembly further comprises a secondary footrest drive link connected between the primary footrest link and the secondary footrest link.

3. The mechanical extending linkage according to claim 2, wherein, when the seating unit is in the retracted position, the primary footrest link is substantially vertically arranged, and the secondary footrest link and the secondary footrest drive link are arranged in such a manner that a distance from the seat to a distal end of the secondary footrest link and a distance from the seat to a distal end of the secondary footrest drive link are smaller than or equal to a distance from the seat to a distal end of the primary footrest link, so as to reduce the thickness of the front part of the seating unit.

4. The mechanical extending linkage according to claim 3, wherein when the seating unit is in the retracted position, the secondary footrest link, the first intermediate link and the second intermediate link are arranged to at least partially overlap one another, and the first, second, third and fourth intermediate links at least partially overlap one another.

5. The mechanical extending linkage according to claim 3, wherein, the primary footrest link, the secondary footrest drive link and the first, second, third and fourth intermediate links each have a first end and a second end;

the secondary footrest drive link, at the first end thereof, is pivotally connected to the secondary footrest link by means of a secondary footrest pivot, and at the second end thereof, is pivotally connected to the first end of the primary footrest link;

the first intermediate link, at the first end thereof, is pivotally connected to an end of the secondary footrest link, and at the second thereof, is pivotally connected to the first end of the third intermediate link, and is pivotally connected to the primary footrest link by means of the primary footrest pivot;

the second intermediate link, at the first end thereof, is pivotally connected to the second end of the primary footrest link, and at the second end thereof, is pivotally connected to the first end of the fourth intermediate link; and both the second end of the third intermediate link and the second end of the fourth intermediate link are pivotally connected to the seat mounting plate.

6. The mechanical extending linkage according to claim 2, wherein the seating unit further comprises an intermediate footrest which is positioned between the seat and the primary footrest to provide further support for legs when the primary footrest is extended.

7. The mechanical extending linkage according to claim 6, wherein the footrest assembly further comprises an intermediate footrest bracket, and an intermediate footrest link having a first end and a second end, and wherein an end of the intermediate footrest bracket is pivotally connected to the second intermediate link; the intermediate footrest link, at the first end thereof, is pivotally connected to the intermediate footrest bracket via an intermediate footrest pivot, and at a second end thereof, is pivotally connected to the first intermediate link.

8. The mechanical extending linkage according to claim 7, wherein when the seating unit is in the retracted position, the intermediate footrest link and the intermediate footrest bracket are arranged substantially parallel with the seat, and a distance between the seat and a distal end of the intermediate footrest link and a distance between the seat and a distal end of the intermediate footrest bracket are smaller than a distance between the seat and a distal end of the primary footrest link.

9. The mechanical extending linkage according to claim 2, wherein the second intermediate link and the fourth intermediate link are provided with stop members respectively, to stop the footrest assembly during the footrest assembly extending and retracting.

10. The mechanical extending linkage according to claim 2, further comprising a seat assembly and a backrest assembly, wherein the seat assembly allows the seat of the seating unit extending and retracting in a translating manner, and the backrest assembly allows the backrest of the seating unit to be adjustable between a substantially vertical position and a reclined position.

11. The mechanical extending linkage according to claim 10, wherein, the seat assembly comprises the seat mounting plate, a roller mounting plate, a rail mounting plate, at least one rotary link and at least one roller;

the at least one roller is mounted on the roller mounting plate;

the rail mounting plate is provided with a rail groove for the roller;

one end of each of the at least one rotary link is pivotally connected to the roller mounting plate, and the other end thereof is pivotally connected to the rail mounting plate such that the rail mounting plate is coupled to the roller mounting plate to the rail mounting plate, and the rail mounting plate is adapted to fix to a seating unit member independent of the mechanical extending linkage.

12. The mechanical extending linkage according to claim 11, wherein the at least one roller comprises two rollers, and the at least one rotary link comprises a front rotary link and a rear rotary link.

13. The mechanical extending linkage according to claim 11, wherein the backrest assembly comprises a backrest bracket, a backrest support bracket and at least one backrest link, and wherein the backrest bracket and the backrest support bracket are connected to the seat mounting plate and the rail mounting plate via the at least one backrest link.

14. The mechanical extending linkage according to claim 13, wherein, the at least one backrest link comprises a backrest auxiliary link, a backrest rotary link and a backrest lower link each having a first end and a second end, the backrest auxiliary link has generally a U-shape, which link is fixedly connected to the seat mounting plate at the bottom of the U-shape, pivotally connected to the backrest bracket at an end of one leg of the U-shape via a backrest bracket pivot, and pivotally connected to a backrest rotary link via the backrest rotary link pivot at an end of the other leg;

one end of the backrest support bracket is pivotally connected to the backrest bracket, and the other end thereof is pivotally connected to the first end of the backrest rotary link;

the second end of the backrest rotary link is pivotally connected to the first end of a backrest lower link; and the second end of the backrest lower link is pivotally connected to the rail mounting plate.

15. A seating unit movable between a retracted position and an extended position and comprises a seat, a backrest and extendable primary and secondary footrests, the seating unit further comprising a pair of mechanical extending linkages substantially in mirror symmetry, the mechanical extending linkages being configured according to claim 1.

16. The seating unit according to claim 15, wherein the seating unit is a sofa.

17. The seating unit according to claim 16, further comprising a reclined position, wherein when the seating unit is moved from the extended position to the reclined position, the seat is moved forward, and the backrest is moved from a substantially vertical position to tilt backward to form an obtuse angle relative to the seat, and at the same time the primary footrest and the secondary footrest remain in an extended state.

* * * * *